US008096276B2

(12) United States Patent
Aida et al.

(10) Patent No.: US 8,096,276 B2
(45) Date of Patent: Jan. 17, 2012

(54) PLASMA IGNITION DEVICE

(75) Inventors: Futoshi Aida, Chiyoda-ku (JP); Hiroshi Okuda, Chiyoda-ku (JP); Yuichi Muramoto, Chiyoda-ku (JP); Yusuke Naruse, Chiyoda-ku (JP)

(73) Assignee: Mitsubishi Electronic Corporation, Tokyo (JP)

( * ) Notice: Subject to any disclaimer, the term of this patent is extended or adjusted under 35 U.S.C. 154(b) by 0 days.

(21) Appl. No.: 12/853,942

(22) Filed: Aug. 10, 2010

(65) Prior Publication Data

US 2011/0239998 A1 Oct. 6, 2011

(30) Foreign Application Priority Data

Apr. 2, 2010 (JP) ..... 2010-085996

(51) Int. Cl.
*F02P 3/08* (2006.01)
*F02P 23/00* (2006.01)

(52) U.S. Cl. ..... 123/143 B; 123/596; 123/605; 123/620

(58) Field of Classification Search ..... 123/143 B, 123/596, 605, 608, 620
See application file for complete search history.

(56) References Cited

U.S. PATENT DOCUMENTS

| | | | | |
|---|---|---|---|---|
| 4,996,967 | A * | 3/1991 | Rosswurm et al. | 123/598 |
| 6,553,981 | B1 * | 4/2003 | Suckewer et al. | 123/620 |
| 7,827,954 | B2 * | 11/2010 | Nagasawa et al. | 123/143 B |
| 2009/0223474 | A1 * | 9/2009 | Ehrlich | 123/143 B |
| 2010/0206277 | A1 * | 8/2010 | Kajita | 123/620 |
| 2011/0106395 | A1 * | 5/2011 | Aida et al. | 701/102 |

FOREIGN PATENT DOCUMENTS

| | | | |
|---|---|---|---|
| JP | 6-066236 | A | 3/1994 |
| JP | 2002-327672 | A | 11/2002 |
| WO | 2009-088045 | A1 | 7/2009 |

* cited by examiner

*Primary Examiner* — Erick Solis
(74) *Attorney, Agent, or Firm* — Sughrue Mion PLLC

(57) ABSTRACT

A plasma power supply circuit includes a DC/DC converter connected to a DC power supply and outputting a DC voltage, a voltage limit circuit limiting an output voltage from the DC/DC converter to a predetermined value, a PJ capacitor connected to an output end of the DC/DC converter and charged with electric energy used to generate a plasma in a discharge space of the spark plug, and a high-voltage switch connected between the PJ capacitor and the DC/DC converter and controlled to switch ON and OFF so that a charge period of the PJ capacitor is controlled according to running conditions of the internal combustion engine. Hence, the plasma ignition device can prevent damage on an electronic component incorporated therein even at the occurrence of a short and lessen damage on the internal combustion engine caused by an erroneous plasma jet ejection, wearing of the spark plug, and power consumption.

9 Claims, 7 Drawing Sheets

PLASMA IGNITION DEVICE

BACKGROUND OF THE INVENTION

1. Field of the Invention

The present invention relates to a plasma ignition device used for an ignition of an internal combustion engine.

2. Background Art

An ignition performance can be enhanced by a plasma ignition device for an internal combustion engine that ejects a plasma jet into a compressed mixture owing to a capability of providing large ignition energy to the compressed mixture. However, in a case where a spark plug gives off an erroneous spark because of an external variance, the plasma ignition device ejects a plasma jet erroneously and gives damage to the engine. Also, because energy is large, when the ignition device is operated all the times, there arises an inconvenience that the spark plug wears out quickly and power consumption is increased. In order to eliminate such an inconvenience, energy (plasma current value and discharge time) to be provided to the spark plug of the plasma ignition device is controlled according to running conditions of the internal combustion engine as is disclosed in JP-A-6-66236.

The plasma ignition device described above, however, has a problem that an electronic component in the ignition device, such as a rectifying diode, is broken by an eddy current when the center electrode of the spark plug is shorted out with a power supply system, such as a battery.

SUMMARY OF THE INVENTION

The invention was devised in view of the problems discussed above and has an object to provide a plasma ignition device significantly enhanced in robustness, that is, strength against an uncertain external variance.

A plasma ignition device according to an aspect of the invention includes: a plasma discharging spark plug; a spark coil that supplies a discharge voltage to the spark plug according to an ignition signal; and a plasma power supply circuit that is connected to the spark plug in parallel and supplies electric energy used to generate a plasma in a discharge space of the spark plug when a discharge of the spark plug starts. The plasma power supply circuit includes: a DC/DC converter that is connected to a DC power supply and outputs a DC voltage; a voltage limit circuit that limits an output voltage of the DC/DC converter to a predetermined value; a PJ capacitor that is connected to an output end of the DC/DC converter and charged with the electric energy used to generate the plasma in the discharge space of the spark plug; and a high-voltage switch that is connected between the PJ capacitor and the DC/DC converter and controlled to switch ON and OFF so that a charge period of the PJ capacitor is controlled according to a running condition of an internal combustion engine.

According to the plasma ignition device of the invention, not only does it become possible to prevent damage on an electronic component in the ignition device even in a case where the spark plug is shorted out with a power supply system, such as a battery, but it also becomes possible to lessen damage on the internal combustion engine caused by an erroneous ejection of a plasma jet, wearing of the spark plug, and power consumption.

The foregoing and other object, features, aspects, and advantages of the present invention will become more apparent from the following detailed description of the present invention when taken in conjunction with the accompanying drawings.

DESCRIPTION OF THE PREFERRED EMBODIMENTS

First Embodiment

Figure 1:
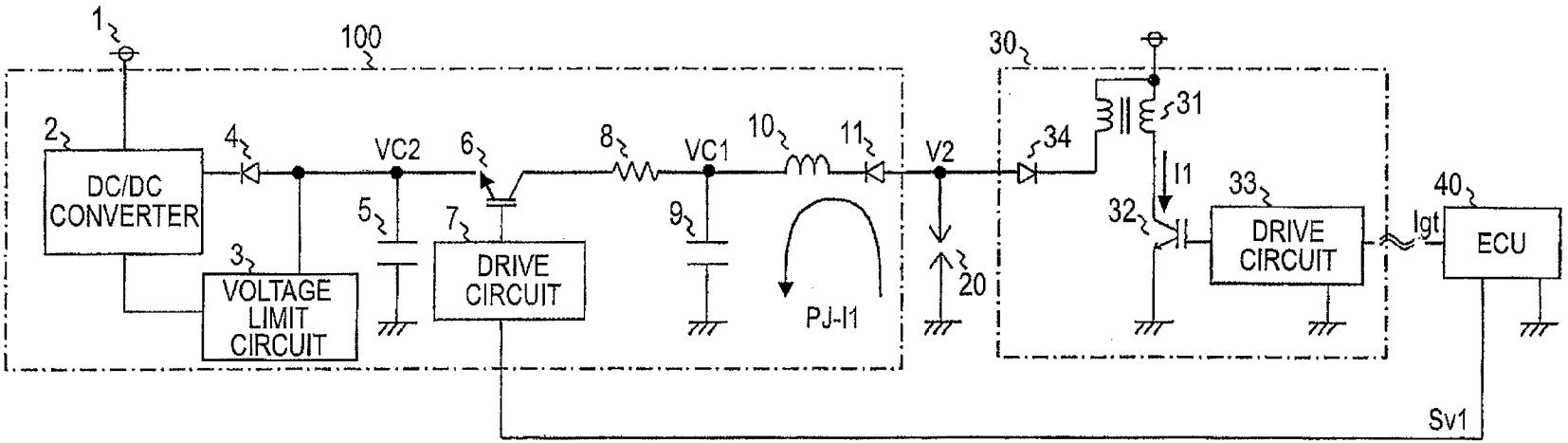
FIG. 1 is a circuit diagram schematically showing the configuration of a plasma ignition device according to a first embodiment of the invention.

FIG. 1 schematically shows the configuration of a plasma ignition device according to a first embodiment of the invention.

The plasma ignition device of the first embodiment includes a spark plug 20, an ignition circuit 30 that generates a high voltage according to an ignition signal Igt from an ECU 40 to produce a discharge in a discharge space of the spark plug 20, and a plasma power supply circuit 100 that provides electric energy to the discharge space in which impedance is lowered by the commencement of a discharge of the spark plug 20 so that a plasma current PJ-I1 is generated to eject a plasma. The ignition circuit 30 and the plasma power supply circuit 100 are connected to the spark plug 20 in parallel with each other.

The ignition circuit 30 includes a spark coil 31, a switching element 32, such as an IGBT, connected to a primary coil of the spark coil 31, a drive circuit 33 that drives the switching element 32 to operate according to the ignition signal Igt from the ECU 40, and a rectifying diode 34 connected between a secondary coil of the spark coil 31 and the spark plug 20.

The ignition circuit 30 applies a discharge voltage to the spark plug 20 via the rectifying diode 34 by driving the switching element 32 according to the ignition signal Igt from the ECU 40 by means of the drive circuit 33 and switching a primary coil current I1 of the spark coil 31.

The plasma power supply circuit 100, which is the characteristic of the invention, includes a DC/DC converter 2, a voltage limit circuit 3, a rectifying diode 4, a tank capacitor 5, a high-voltage switch 6, such as an IGBT, a drive circuit 7, a current limit resistor 8, a PJ capacitor 9, an inductor 10, and a diode 11 for high voltage.

The DC/DC converter 2 is connected to a battery power supply 1 at an input end and a cathode of the rectifying diode 4 at an output end. An anode of the rectifying diode 4 is connected to the voltage limit circuit 3, a high-voltage end of the tank capacitor 5, and an emitter of the high-voltage switch 6. The other end of the tank capacitor 5 is grounded. A gate of the high-voltage switch 6 is connected to the drive circuit 7 and a collector thereof is connected to the current limit resistor 8. The other end of the drive circuit 7 is connected to the ECU 40. The other end of the current limit resistor 8 is connected to a high voltage end of the PJ capacitor 9 and the inductor 10. The other end of the PJ capacitor 9 is grounded. The other end of the inductor 10 is connected to a cathode of the diode 11 for high voltage, and an anode of the diode 11 for high voltage is connected to the spark plug 20.

The functions of the DC/DC converter 2, the tank capacitor 5, and the current limit resistor 8 are to charge the PJ capacitor 9. Accordingly, a capacity value of the tank capacitor 5 is set larger than a capacity value of the PJ capacitor 9.

The high-voltage switch 6 is controlled to switch ON and OFF according to a control command signal Sv1 outputted from the ECU 40 synchronously with the ignition signal Igt. It is switched ON when a voltage signal in a high state is supplied to the gate via the drive circuit 7 as the control command signal Sv1, so that the PJ capacitor 9 is charged by the DC/DC converter 2, the tank capacitor 5, and the current limit resistor 8 as described above. Accordingly, the PJ capacitor 9 is charged only at the timing at which the voltage signal Sv1 in a high state is supplied from the ECU 40. It thus becomes possible to limit a period during which the PJ capacitor 9 is charged.

Figure 2:
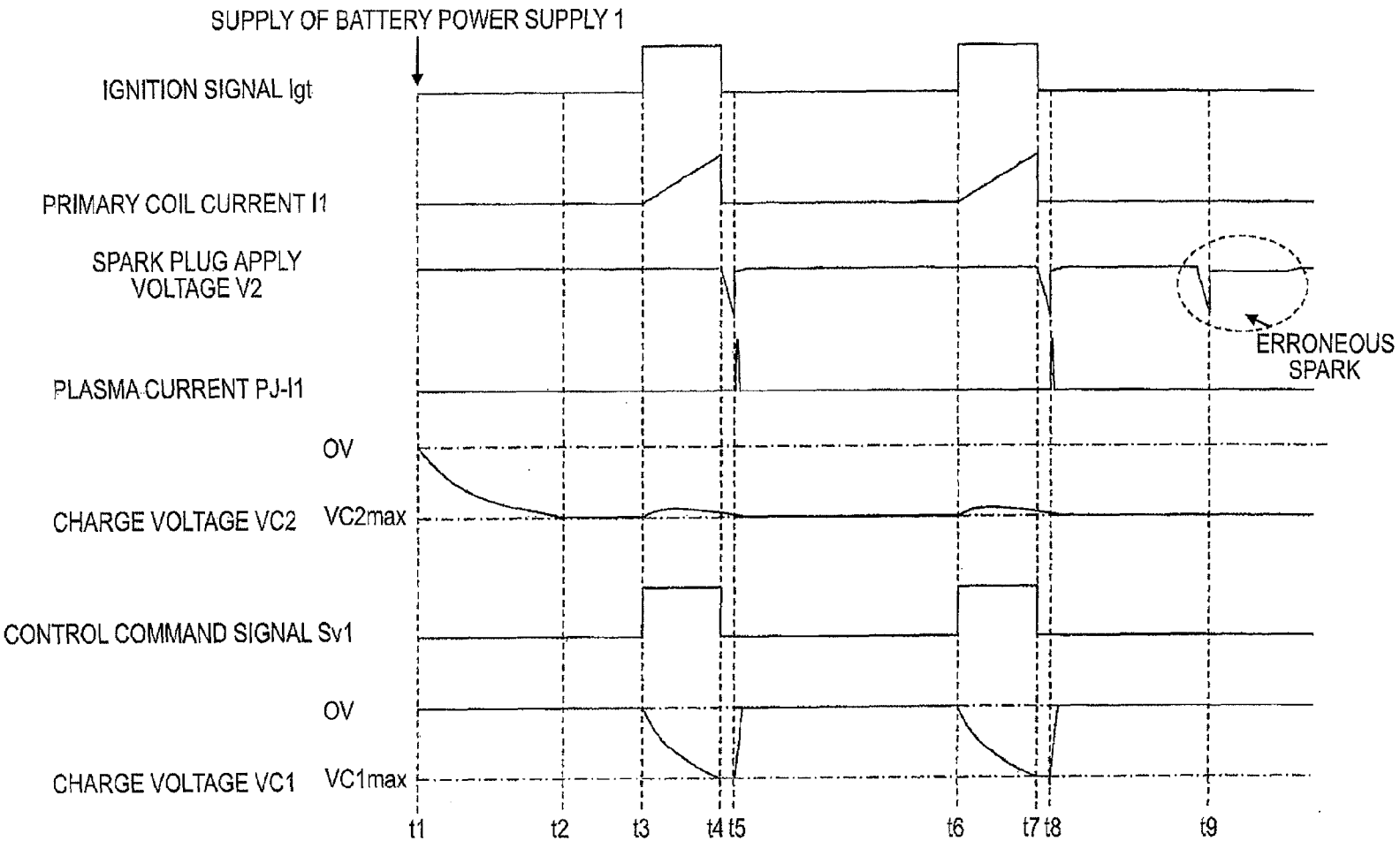
FIG. 2 is a timing chart at respective operation points in the first embodiment.

FIG. 2 is a timing chart of the waveforms of the respective portions in the first embodiment.

When the battery power supply 1 is supplied at a time t1, the DC/DC converter 2 in the plasma power supply circuit 100 starts to operate and charges the tank capacitor 5.

When a charge voltage VC2 of the tank capacitor 5 reaches a set voltage VC2max of the voltage limit circuit 3 at a time t2, the DC/DC converter 2 is stopped operating.

When the control command signal Sv1 in a high state is supplied from the ECU 40 at a time t3 (for example, at the rising of the ignition signal Igt), the high-voltage switch 6 is switched ON and charging of the PJ capacitor 9 from the tank capacitor 5 is started. When the control command signal Sv1 is switched to a low state at a time t4 (for example, at the falling of the ignition signal Igt), the high-voltage switch 6 is switched OFF and the charging is stopped.

At a time t5, a high voltage V2 is applied to the spark plug 20 to give rise an insulation breakdown, and electric energy is provided from the plasma power supply circuit 100 to the discharge space in which impedance is lowered because of the commencement of a discharge. The plasma current PJ-I1 thus flows to eject a plasma. As the plasma current PJ-I1 flows, charges charged in the PJ capacitor 9 are released and a charge voltage VC1 drops to 0 V. Thereafter, this operation is repeated from a time t6 to a time t8.

Then, the spark plug 20 gives off an erroneous spark at a time point t9 because of an external variance. However, because no charges are charged in the PJ capacitor 9, the plasma current PJ-I1 does not flow in the spark plug 20.

In a case where the spark plug 20 is shorted out with the battery power supply 1, when the high-voltage switch 6 is ON, the current limit resistor 8 and the inductor 10 suppress a current flowing toward the DC/DC converter 2 and when the high-voltage switch 6 is OFF, the inductor 10 suppresses a current flowing into the PJ capacitor 9 and the diode 11. In this manner, damage on an electronic component in the plasma power supply circuit 100, such as the rectifying diode 4, is lessened.

FIG. 1 shows a case where the diode 11 for high voltage and the rectifying diode 34 are disposed in a direction in which the center electrode of the spark plug 20 is the cathode. It should be appreciated, however, that the diode 11 for high voltage and the rectifying diode 34 may be disposed in a direction in which the center electrode of the spark plug 20 is the anode.

As has been described, the plasma ignition device according to an aspect of the invention includes: the plasma discharging spark plug 20; the spark coil 31 that supplies a discharge voltage to the spark plug 20 according to the ignition signal Igt; and the plasma power supply circuit 100 that is connected to the spark plug 20 in parallel and supplies electric energy used to generate a plasma in a discharge space of the spark plug 20 when a discharge of the spark plug 20 starts. The plasma power supply circuit 100 includes: the DC/DC converter 2 that is connected to the DC power supply 1 and outputs a DC voltage; the voltage limit circuit 3 that limits an output voltage of the DC/DC converter 2 to a predetermined value; the PJ capacitor 9 that is connected to an output end of the DC/DC converter 2 and charged with the electric energy used to generate the plasma in the discharge space of the spark plug 20; and the high-voltage switch 6 that is connected between the PJ capacitor 9 and the DC/DC converter 2 and controlled to switch ON and OFF so that a charge period of the PJ capacitor 9 is controlled according to a running condition of the internal combustion engine. Accordingly, not only does it become possible to prevent damage on an electronic component in the ignition device even in a case where the spark plug is shorted out with a power supply system, such as a battery, but it also becomes possible to lessen damage on the engine caused by an erroneous ejection of a plasma jet, wearing of the spark plug, and power consumption.

Figure 3:
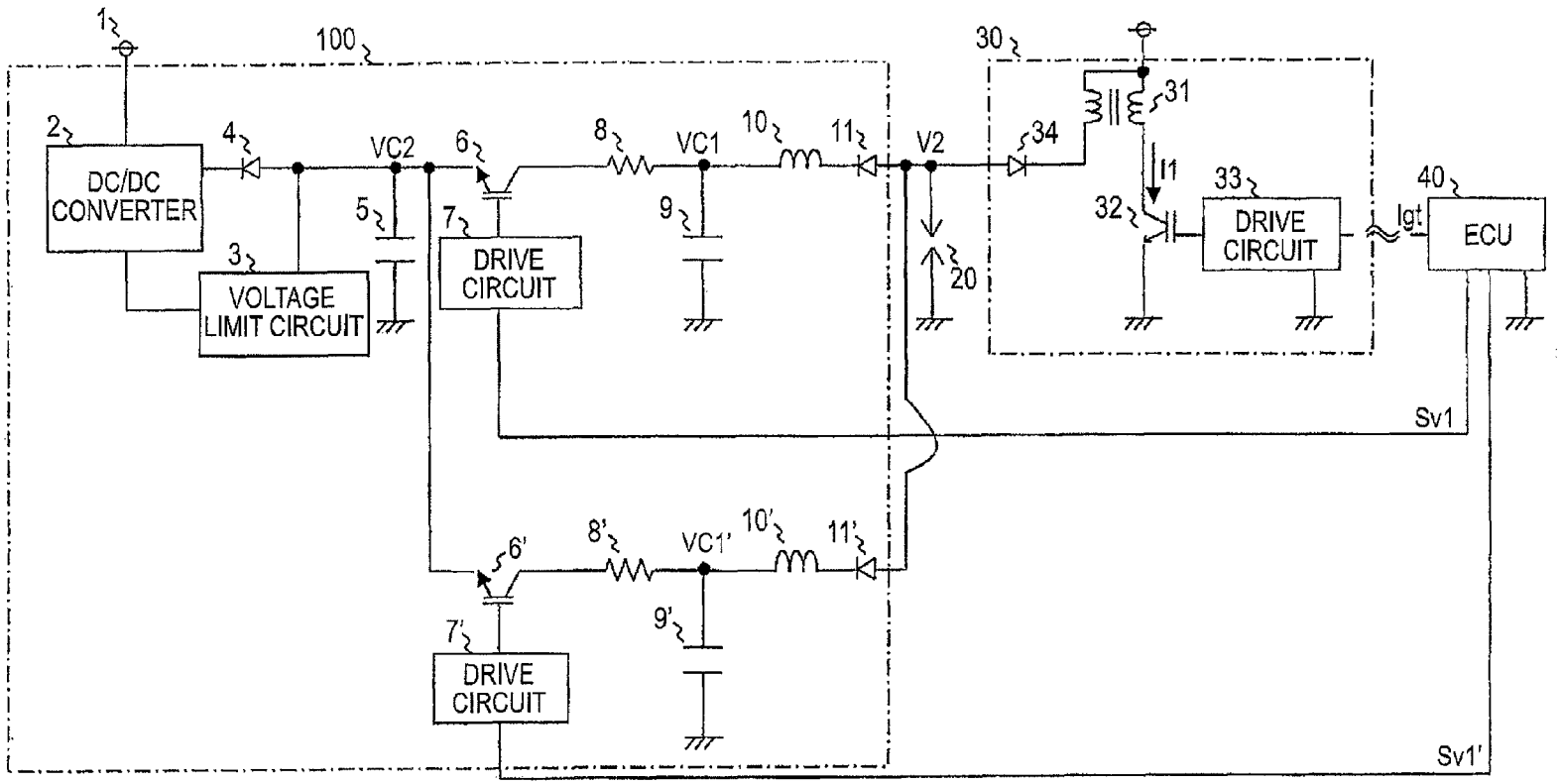
FIG. 3 is a circuit diagram schematically showing the configuration of a modification of the first embodiment.
Figure 4:
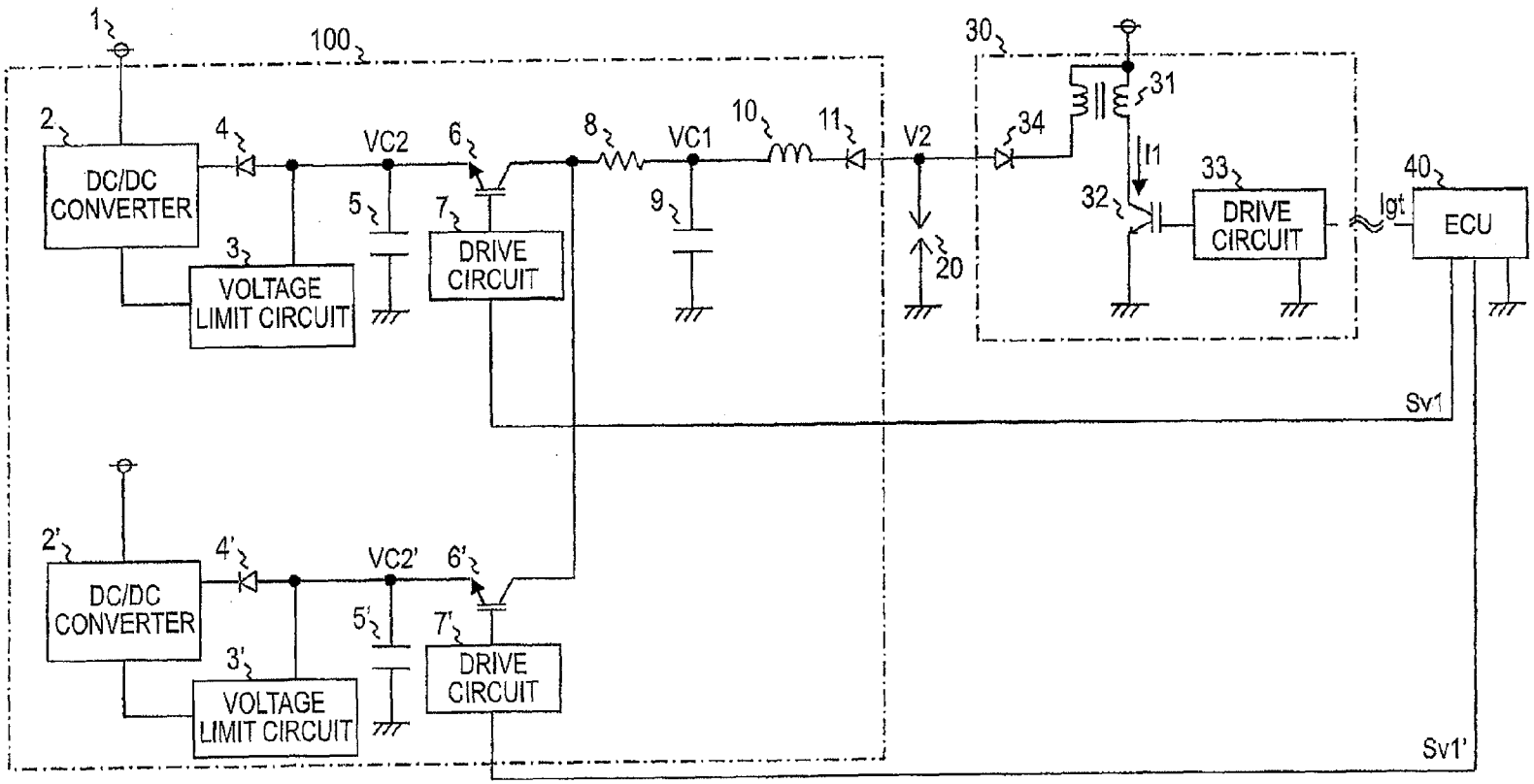
FIG. 4 is a circuit diagram schematically showing the configuration of another modification of the first embodiment.
Figure 5:
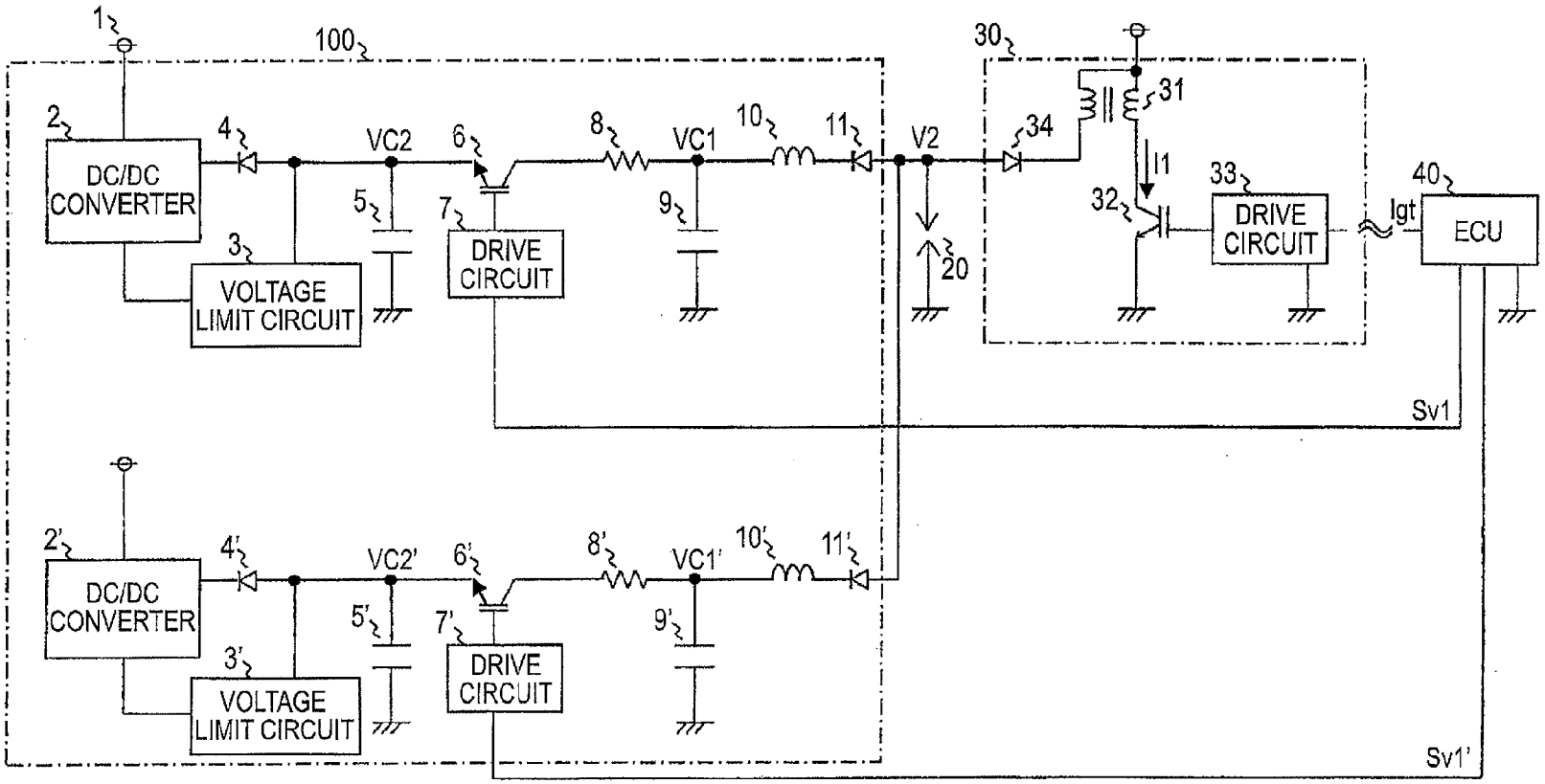
FIG. 5 is a circuit diagram schematically showing the configuration of still another modification of the first embodiment.

FIG. 3 through FIG. 5 are circuit diagrams schematically showing the configurations of respective modifications of the first embodiment.

For example, as is shown in FIG. 3, two sets of high-voltage switches 6 and 6', drive circuits 7 and 7', current limit resistors 8 and 8', PJ capacitors 9 and 9', inductors 10 and 10', and diodes 11 and 11' for high voltage are disposed in the plasma power supply circuit 100. A capacity value of the PJ capacitor 9 is set larger than a capacity value of the PJ capacitor 9' and control command signals Sv1 and Sv1' from the ECU 40 are supplied selectively (either one of them is supplied or both are supplied simultaneously). When configured in this manner, plasma energy can be variable.

Alternatively, as is shown in FIG. 4, two sets of DC/DC converters 2 and 2', voltage limit circuits 3 and 3', rectifying diodes 4 and 4', tank capacitors 5 and 5', the high-voltage switches 6 and 6', and the drive circuits 7 and 7' are disposed in the plasma power supply circuit 100. The limit voltage VC2 of the voltage limit circuit 3 is set larger than a limit voltage VC2' of the voltage limit circuit 3' and the control signals Sv1 and Sv1' from the ECU 40 are supplied selectively (either one of them is supplied). When configured in this manner, plasma energy can be variable.

Further, as is shown in FIG. 5, two sets of the DC/DC converters 2 and 2', the voltage limit circuits 3 and 3', the rectifying diodes 4 and 4', the tank capacitors 5 and 5', the high-voltage switches 6 and 6', the drive circuits 7 and 7', the current limit resistors 8 and 8', the PJ capacitors 9 and 9', the inductors 10 and 10', and the diodes 11 and 11' for high voltage are disposed in the plasma power supply circuit 100. A capacity value of the PJ capacitor 9 is set larger than a capacity value of the PJ capacitor 9' and the limit voltage VC2 of the voltage limit circuit 3 is set larger than the limit voltage VC2' of the voltage limit circuit 3'. Also, the control signals Sv1 and Sv1' from the ECU 40 are supplied selectively (either one of them is supplied or both are supplied simultaneously). When configured in this manner, plasma energy can be variable.

Second Embodiment

Figure 6:
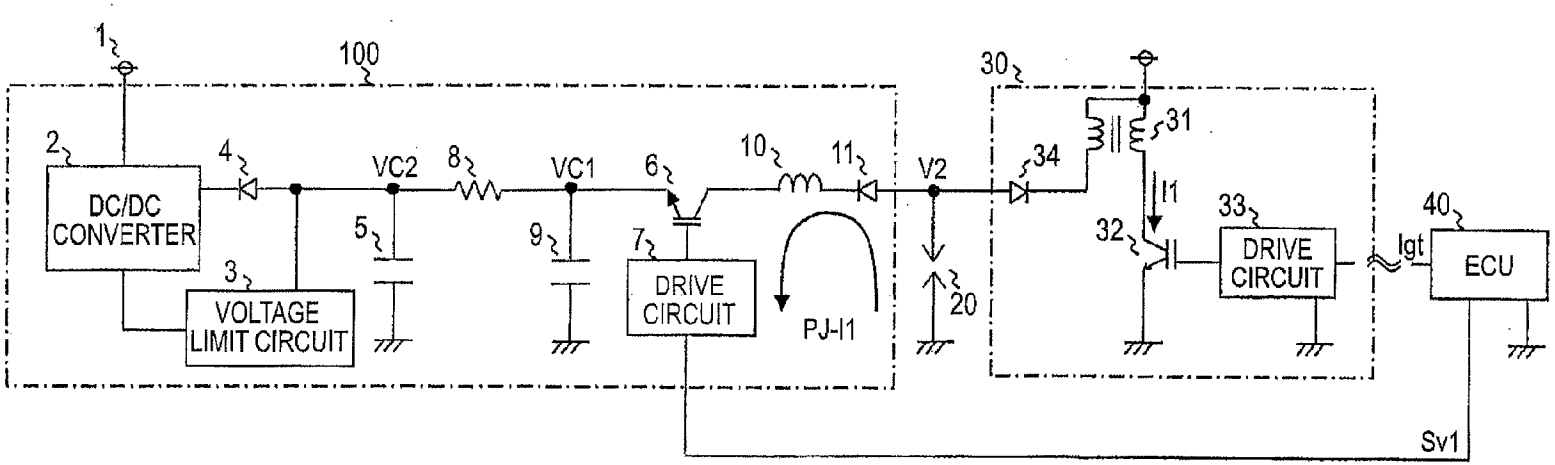
FIG. 6 is a circuit diagram schematically showing the configuration of a plasma ignition device according to a second embodiment of the invention.

FIG. 6 schematically shows the configuration of a plasma ignition device according to a second embodiment of the invention.

In contrast to the plasma ignition device of the first embodiment above in which the high-voltage switch 6 is disposed between the tank capacitor 5 and the current limit resistor 8 in the plasma power supply circuit 100, in the plasma ignition device of the second embodiment, the high-voltage switch 6 is disposed between the PJ capacitor 9 and the inductor 10. Because other configurations are the same as those of the first embodiment above, a description thereof is omitted herein.

Figure 7:
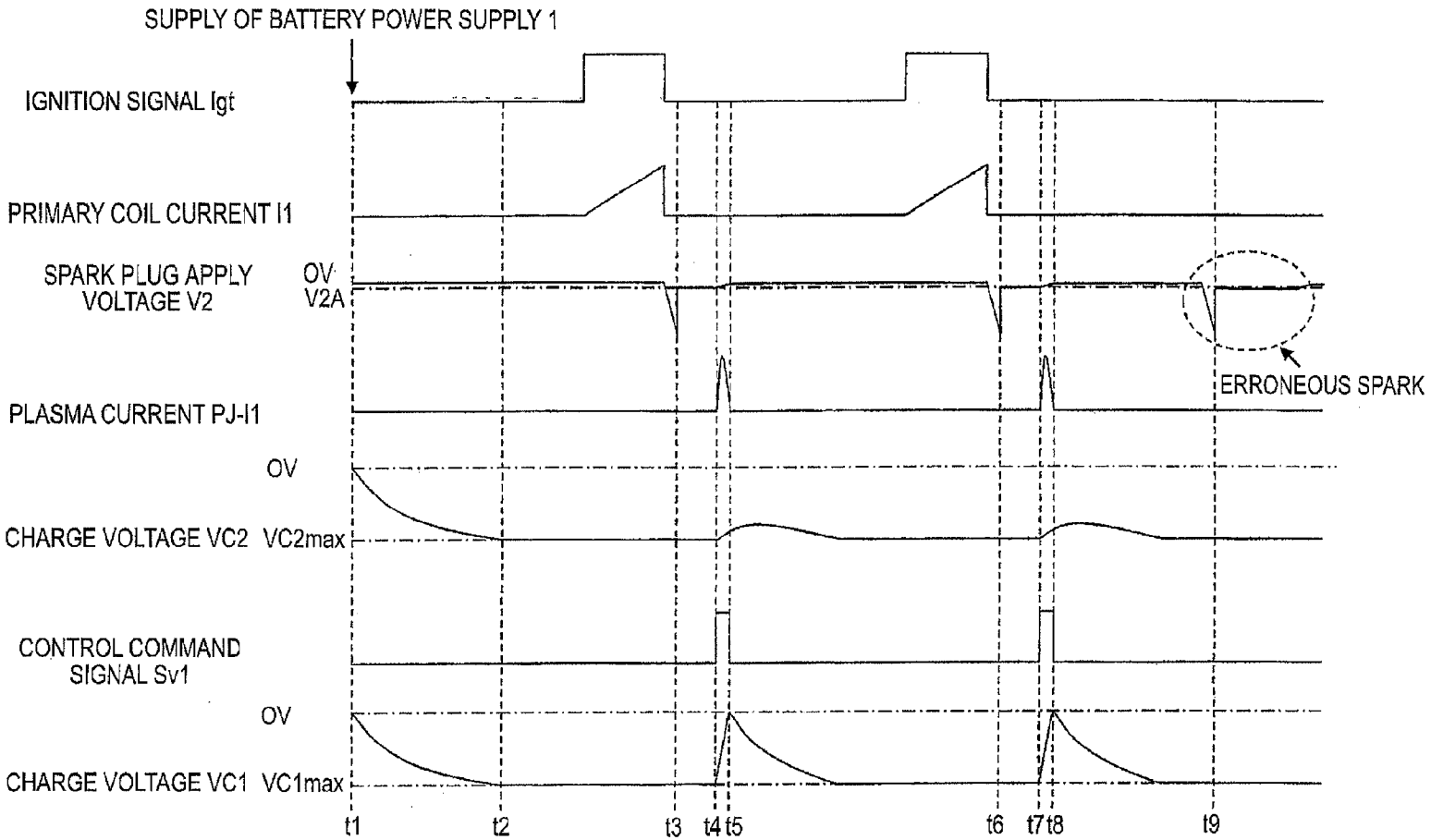
FIG. 7 is a timing chart at respective operation points in the second embodiment.

FIG. 7 shows a timing chart of waveforms of respective portions in the second embodiment.

When the battery power supply 1 is supplied at the time t1, the DC/DC converter 2 in the plasma power supply circuit 100 starts to operate and charges the tank capacitor 5 and the PJ capacitor 9.

When the charge voltage VC2 of the tank capacitor 5 reaches the set voltage VC2max of the voltage limit circuit 3 at the time t2, the DC/DC converter 2 is stopped operating.

At the time t3, the high voltage V2 is applied to the spark plug 20 to give rise to an insulation breakdown and impedance of a discharge space between the center electrode and the ground electrode of the spark plug 20 lowers because of the commencement of a discharge. Thereafter, when the control command signal Sv1 in a high state is supplied from the ECU 40 at the time t4 that is timing at which the plasma current PJ-I1 is to be flown into the discharge space, that is, timing at which a plasma jet is to be ejected, the high-voltage switch 6 is switched ON. Accordingly, electric energy is provided to the discharge space from the plasma power supply circuit 100 and the plasma current PJ-I1 flows to eject the plasma. As the plasma current PJ-I1 flows, charges charged in the PJ capacitor 9 are released and the charge voltage VC1 drops to 0 V. When the control command signal Sv1 is switched to a low state at the time t5, the high-voltage switch 6 is switched OFF. The PJ capacitor 9 and the inductor 10 are thus electrically isolated from each other. Also, when the charge voltage VC2 of the tank capacitor 5 drops to or below the set voltage VC2max of the voltage limit circuit 3 at the time t4, the DC/DC converter 2 starts to operate and charges the tank capacitor 5 and the PJ capacitor 9. Thereafter, this operation is repeated from the time t6 to the time t8.

It should be noted that the charge voltage VC1 of the PJ capacitor 9 is set smaller than a discharge maintaining voltage V2A of the ignition circuit 30 in absolute value (|V2A−VC1|>Vf: a voltage dropping in a forward direction of the diode 11 for high voltage).

The spark plug 20 then gives off an erroneous spark at the time t9 because of an external variance. However, because the high-voltage switch 6 is OFF, the plasma current PJ-I1 does not flow into the spark plug 20. Also, in a case where the spark plug 20 is shorted out with the battery power supply 1, when the high-voltage switch 6 is ON, the current limit resistor 8 and the inductor 10 suppress a current flowing toward the DC/DC converter 2 to lessen damage on an electronic component and when the high-voltage switch 6 is OFF, no damage is given to an electronic component because there is no path for a current to flow toward the DC/DC converter 2.

According to the second embodiment, the high-voltage switch 6 is connected between the PJ capacitor 9 and the spark plug 20 and it is controlled to switch ON and OFF to supply a plasma current to the spark plug 20 from the PJ capacitor 9 according to the control command signal Sv1 corresponding to running conditions of the internal combustion engine. Hence, not only does it become possible to lessen damage on the engine caused by an erroneous ejection of a plasma jet, wearing of the spark plug, and consumption power without breaking an electronic component in the ignition device even in a case where the spark plug is shorted out with a power supply system, such as a battery, but it also becomes possible to eject a plasma jet at the most effective point for combustion.

Various modifications and alterations of this invention will be apparent to those skilled in the art without departing from the scope and spirit of this invention, and it should be understood that this is not limited to the illustrative embodiments set forth herein.

What is claimed is:

1. A plasma ignition device, comprising:

a plasma discharging spark plug;

a spark coil that supplies a discharge voltage to the spark plug according to an ignition signal; and a plasma power supply circuit that is connected to the spark plug in parallel and supplies electric energy used to generate a plasma in a discharge space of the spark plug when a discharge of the spark plug starts, wherein the plasma power supply circuit includes:

a DC/DC converter that is connected to a DC power supply and outputs a DC voltage;

a voltage limit circuit that limits an output voltage of the DC/DC converter to a predetermined value;

a PJ capacitor that is connected to an output end of the DC/DC converter and charged with the electric energy used to generate the plasma in the discharge space of the spark plug; and a high-voltage switch that is connected between the PJ capacitor and the DC/DC converter and controlled to switch ON and OFF so that a charge period of the PJ capacitor is controlled according to a running condition of an internal combustion engine.

2. The plasma ignition device according to claim 1, wherein:

in a period during which the ignition signal is supplied, the high-voltage switch is switched ON to charge the PJ capacitor and in a period during which the ignition signal is not supplied, the high-voltage switch is switched OFF to stop charging of the PJ capacitor.

3. The plasma ignition device according to claim 1, wherein:

the high-voltage switch is connected to a tank capacitor connected to an output end of the DC/DC converter via a rectifying diode at one end and to the PJ capacitor via a current limit resistor at the other end.

4. The plasma ignition device according to claim 1, wherein:

the plasma power supply circuit includes the PJ capacitor and the high-voltage switch in two sets disposed in parallel for the DC/DC converter.

5. The plasma ignition device according to claim 1, wherein:

the plasma power supply circuit includes the DC/DC converters, the voltage limit circuits, and the high-voltage switches in two sets disposed in parallel for the PJ capacitor.

6. The plasma ignition device according to claim 1, wherein:

the plasma power supply circuit includes the DC/DC converters, the voltage limit circuits, the PJ capacitors, the high-voltage switches, and the PJ capacitors in two sets disposed in parallel for the spark plug.

7. A plasma ignition device, comprising:

a plasma discharging spark plug;

a spark coil that supplies a discharge voltage to the spark plug according to an ignition signal; and a plasma power supply circuit that is connected to the spark plug in parallel and supplies electric energy used to generate a plasma in a discharge space of the spark plug when a discharge of the spark plug starts, wherein the plasma power supply circuit includes:

a DC/DC converter that is connected to a DC power supply and outputs a DC voltage;

a voltage limit circuit that limits an output voltage of the DC/DC converter to a predetermined value;

a PJ capacitor that is connected to an output end of the DC/DC converter and charged with the electric energy used to generate the plasma in the discharge space of the spark plug; and a high-voltage switch that is connected between the PJ capacitor and the spark plug and controlled to switch ON and OFF so that a plasma current is supplied from the PJ capacitor to the spark plug according to a running condition of an internal combustion engine.

8. The plasma ignition device according to claim 7, wherein:

the high-voltage switch is switched ON in a period during which the plasma current is supplied to the spark plug and switched OFF in a period during which the plasma current is not supplied to the spark plug.

9. The plasma ignition device according to claim 7, wherein:

the high-voltage switch is connected to the PJ capacitor at one end and to the spark plug at the other end via an inductor and a diode.

* * * * *